United States Patent [19]

Bergman

[11] 4,027,188

[45] May 31, 1977

[54] TUBULAR PLASMA DISPLAY SEAL DESIGN

[75] Inventor: Clark Bergman, Roseville, Minn.

[73] Assignee: The United States of America as represented by the Secretary of the Air Force, Washington, D.C.

[22] Filed: June 23, 1976

[21] Appl. No.: 698,989

[52] U.S. Cl. ..... 313/220; 313/188

[51] Int. Cl.[2] ..... H01J 61/30

[58] Field of Search ..... 313/220, 188

[56] References Cited

UNITED STATES PATENTS

| | | | |
|---|---|---|---|
| 3,704,052 | 11/1972 | Coleman | 313/220 UX |
| 3,755,027 | 8/1973 | Gilsing | 313/220 X |

*Primary Examiner*—Rudolph V. Rolinec
*Assistant Examiner*—Darwin R. Hostetter
*Attorney, Agent, or Firm*—Joseph E. Rusz; Henry S. Miller, Jr.

[57] ABSTRACT

In a tubular plasma display consisting of an array of parallel glass capillary tubes sealed in a plenum and attached to a rigid substrate, having different thermal expansion properties limiting operational temperature range, the improvement being an extension to the substrate creating a gap which separates the tube manifold from the nearest point where the tube and substrate are bonded.

1 Claim, 3 Drawing Figures

TUBULAR PLASMA DISPLAY SEAL DESIGN

STATEMENT OF GOVERNMENT INTEREST

The invention described herein may be manufactured and used by or for the Government for governmental purposes without the payment of any royalty thereon.

BACKGROUND OF THE INVENTION

This invention relates generally to a tubular plasma display and more specifically to an improved tubular seal design that will allow the display to operate over a wider temperature range.

The tubular construction techniques for fabricating AC plasma display panels has been under development for a number of years. The availability of precision glass tubing and the ease of utilizing the tubing has made possible the advent of large display panels.

These display panels function well when operated in a controlled environment. However, when subjected to mechanical shock, vibration and drastic temperature extremes, glass capillary tubes, connected to a common vacuum manifold, tend to fracture and break, thereby allowing atmospheric gases to enter the system and effectively disable the display panel.

Although various types of materials and sealants have been considered and tried, in order to solve the problem, none have thus far proven satisfactory.

SUMMARY OF THE INVENTION

The invention relates to a mechanical technique for solving the problem created by temperature change, mechanical shock and vibration in tubular plasma display devices.

The display device consists of a base, which may be a fiberglass epoxy laminate or other suitable material, with a plurality of orthogonally positioned electrodes in layers on the base. Between the layers of orthogonal electrodes is a layer containing a plurality of capillary discharge tubes. A transparent faceplate covers the layers of electrodes and capillaries. The elements of the display are laminated with thermosetting epoxy adhesives.

The capillary discharge tubes are generally formed of a soft glass and connected at least at one end to the vacuum manifold. The manifold may be a three-piece assembly of stainless steel connecting all discharge tubes and allowing a uniform gas mixture throughout the panel.

The base electrodes are etched in a copper cladding bonded to the base material. Capillary discharge tubes are then bonded to the base electrodes on a one basis. Orthogonal electrodes are contained on a thin plastic film to which a copper foil has been bonded and electrodes etched therein. The film is applied to the structure over the capillary tubes and defines the position of discharge spots within the tubes. A protective faceplate is then bonded to the display surface.

The stainless steel vacuum manifold is affixed directly to the base and so arranged that the capillary discharge tubes open directly into the manifold. A gas reservoir consisting of a small container mounted behind the display panel provides long-term gas mixture stability and is connected to the panel via a tube extending from the manifold. A low vapor-pressure vacuum sealant is used to join the manifold parts.

In prior art devices, the manifold, capillary discharge tubes and base meet at a common junction. During periods of elevated temperature, stresses are caused by the expansion of the different parts. When additional external stresses are applied to the display at high temperature, the glass capillary discharge tubes tend to fracture at the common of juncture. It has been found that by fabricating the display with approximately a 0.4-inch space between the tube-manifold connection and the nearest point where the tubes and base are bonded, fracturing of the glass is virtually eliminated. Experimental results demonstrate that this structure successfully functions under adverse conditions in the temperature range −80° to +130° without damage.

It is therefore an object of the invention to provide a new and improved plasma display panel.

It is another object of the invention to provide a new and improved plasma display panel that will operate through a temperature range greater than any hitherto known.

It is a further object of the invention to provide a new and improved plasma display panel that will withstand shock and vibration better than any known similar device.

It is still another object of the invention to provide a new and improved plasma display panel that resists capillary-discharge-tube fracture at high operating temperatures.

It is still a further object of the invention to provide a new and improved plasma display panel which is economical to produce and utilizes currently available components.

These and other advantages, features and objects of the invention will become more apparent from the following description taken in connection with the illustrate embodiment in the accompanying drawings.

DESCRIPTION OF THE PREFERRED EMBODIMENT

Figure 1:
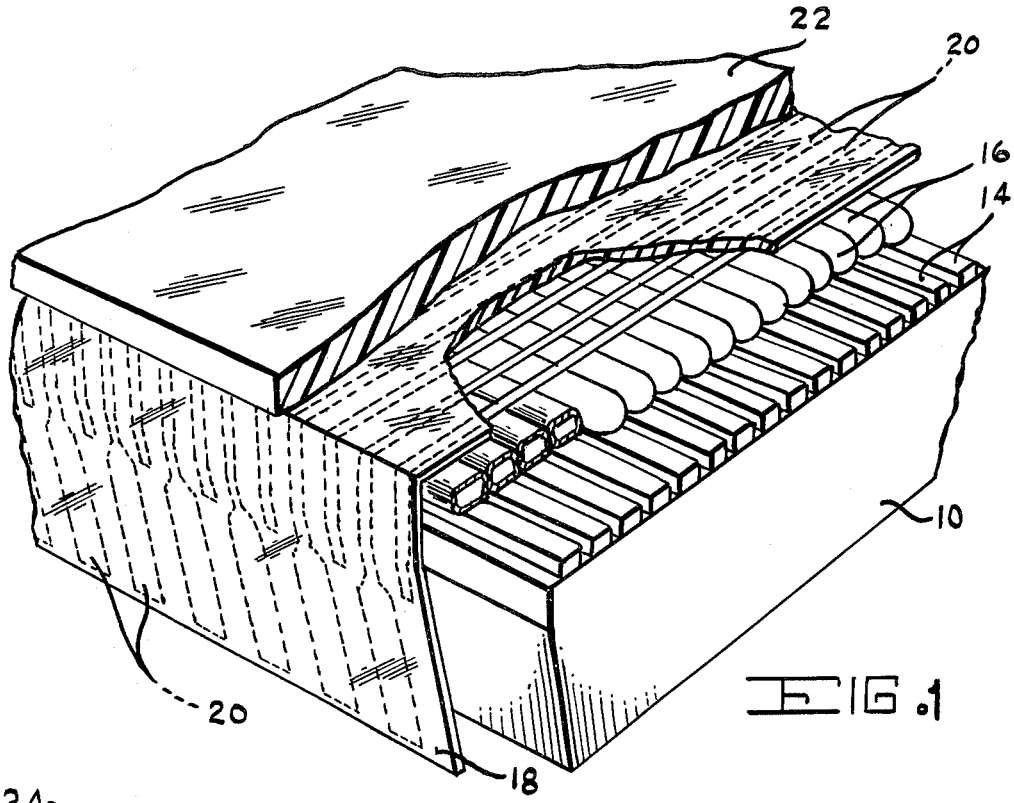
FIG. 1 is a schematic representation of a typical plasma display panel.

Referring now to FIG. 1, the primary structural component of the panel is a base 10, which may be formed of glass, glass-metal, cast polyimide resin, fiberglass-epoxy laminate or other suitable material. The material is selected on the basis of strength and thermal expansion qualities in order that all materials might be closely matched. A conductive cladding, for example copper, is bonded to the active side of the base. A plurality of parallel electrodes 14 are etched in the cladding material.

Affixed to each base electrode 14 is a capillary discharge tube 16. Each tube is formed of a soft glass and closed at one end. The remaining end opens into a vacuum manifold as shown in FIGS. 2 and 3.

A thin plastic film 18 overlies the discharge tube 16 and contains a plurality of drive electrodes 20 which are etched from a conductive film bonded to the plastic. The drive electrodes are transverse to the base electrodes and through the appropriate application of voltage to the electrodes define discharge spots in the tubes 16. A protective transparent face plate 22 covers the entire package and protects the aforementioned individual components.

Figure 2:
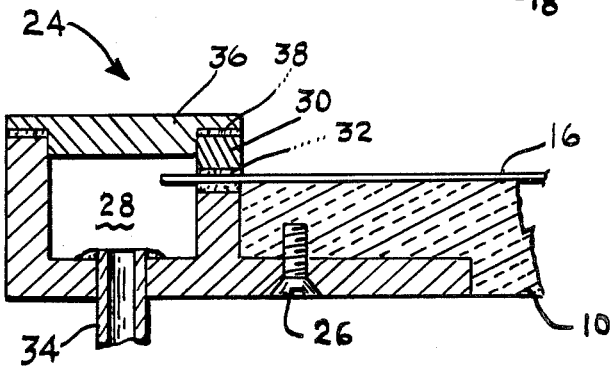
FIG. 2 PRIOR ART
FIG. 2 is a cross-sectional view of a vacuum manifold-capillary discharge tube connection used in the prior art.

FIG. 2 shows the vacuum manifold generally at 24, affixed to the base 10 by the screws 26. The manifold-base connection may be further strengthened by use of an appropriate adhesive on their common interface. The base in FIG. 3 is provided with an extension 11 whose thickness is less than the base and is positioned so as to avoid contact with the capillary discharge tubes 16. Capillary discharge tubes 16 pass through the wall 30 and open into the vacuum chamber-plenum 28. The vacuum sealant 32 is provided around each discharge tube. A gas reservoir (not shown) provides long-term gas mixture stability and is connected to the vacuum chamber via tubing 34. Vacuum chamber 28 may consist of three stainless steel sides with a cover 36 and an appropriate bond-seal as shown at 38, or other suitable configurations. In the prior art figure, the base 10 is secured to the vacuum chamber 28 and closely abutts the chamber in all dimensions. The capillary discharge tubes 16 are bonded to base 10 from the wall 30 to their distal termination. Differences in thermal expansion and contraction cause uneven stresses to be created in the different elements. These stresses, as they become excessive, cause damage which most often occurs to the dishcarge tubes since they are the weakest structural member.

Figure 3:
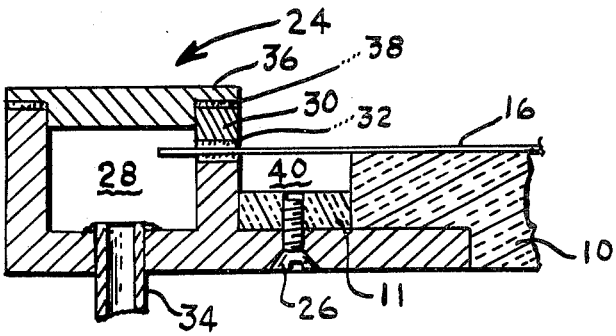
FIG. 3 is a cross sectional view of the improved vacuum manifold-capillary discharge tube connection of the invention.

Concerning FIG. 3, in order to relieve the stresses created during thermal expansion and contraction, it has been found that by providing a recessed area 40, in the base material abutting the plenum wall 30, adjacent to the capillary discharge tubes 16, sufficient stress is relieved to prevent fracturing of the tubes. A 0.4-inch space between the tube manifold connection and the nearest point where the tube and base are bonded is usually sufficient to accomplish the objective. Smaller gaps have also proved successful. Expansion and contraction in either the plenum chamber, base or capillary discharge tubes is now an independent factor, thereby allowing a wider variety of materials to be utilized. The recess extends the entire length of the base-manifold interface and includes the area adjacent to each capillary discharge tube.

Although the invention has been described with reference to a particular embodiment, it will be understood to those skilled in the art that the invention is capable of a variety of alternative embodiments within the spirit and scope of the appended claims.

What is claimed is:

1. In a tubular plasma display having a base, a plurality of parallel electrodes affixed to the base, a plurality of capillary discharge tubes bonded to the electrodes, a plurality of electrodes overlying said capillary discharge tubes and transverse thereto, and a protective face plate covering the electrodes, discharge tubes and base, further including a manifold chamber affixed to the base wherein at least one end of each capillary discharge tube opens into the chamber, the improvement comprising: an extension of the base by a thickness less than that of the base, extending in a direction toward and abutting the manifold chamber and removed from contact with the capillary discharge tubes.

* * * * *